US008967402B2

(12) United States Patent
Pintur

(10) Patent No.: US 8,967,402 B2
(45) Date of Patent: Mar. 3, 2015

(54) PANEL FOR EXHIBITING ITEMS, WITH CHANGEABLE ELEMENTS

(71) Applicant: Mladen Pintur, Zagreb (HR)

(72) Inventor: Mladen Pintur, Zagreb (HR)

( * ) Notice: Subject to any disclaimer, the term of this patent is extended or adjusted under 35 U.S.C. 154(b) by 12 days.

(21) Appl. No.: 13/770,721

(22) Filed: Feb. 19, 2013

(65) Prior Publication Data

US 2013/0220947 A1 Aug. 29, 2013

(30) Foreign Application Priority Data

Feb. 23, 2012 (DE) ..... 10 2012 202 806

(51) Int. Cl.
*A47H 1/00* (2006.01)
*A47B 43/00* (2006.01)
*A47B 47/00* (2006.01)
(Continued)

(52) U.S. Cl.
CPC ..... *A47F 5/0018* (2013.01); *A47B 96/1466* (2013.01); *A47B 47/02* (2013.01); *A47B 47/022* (2013.01); *A47B 47/03* (2013.01); *A47B 2096/1491* (2013.01); *A47F 5/103* (2013.01); *A47B 57/30* (2013.01); *A47B 96/145* (2013.01);
(Continued)

(58) Field of Classification Search
CPC ..... B25H 3/04; A47F 5/10; A47F 5/101; A47F 5/103; A47F 5/105; A47F 5/13; A47F 5/132; A47F 5/16; A47F 9/00; A47F 5/00; A47F 5/0018; A47G 1/17; A47B 57/00; A47B 57/06; A47B 57/30; A47B 55/00; A47B 53/00; A47B 47/02; A47B 47/04; A47B 47/021; A47B 47/027; A47B 47/03; A47B 47/022; A47B 47/05; A47B 47/055; A47B 47/00; A47B 47/0008; A47B 47/0025; A47B 85/00; A47B 96/14; A47B 96/1408; A47B 96/1416; A47B 96/1433; A47B 96/1466; A47B 96/145; A47B 2096/1491; A47B 2096/209; A47B 57/42; A47B 57/34; A47B 57/32; A47B 57/56; A47B 57/562; A47B 57/565
USPC ..... 211/204, 206, DIG. 1, 103, 187, 193, 211/150, 86.01, 87.01; 108/106–108, 108/147.12, 147.15; 248/206.5, 309.4, 248/225.11, 223.41, 224.51
See application file for complete search history.

(56) References Cited

U.S. PATENT DOCUMENTS 3,200,775 A * 8/1965 Peters ..... 108/108
3,346,124 A * 10/1967 Sobel ..... 211/193
(Continued)

FOREIGN PATENT DOCUMENTS

DE 89 12 144 U1 11/1989
DE 20 2011 003 274 U1 5/2011
(Continued)

*Primary Examiner* — Jennifer E Novosad
(74) *Attorney, Agent, or Firm* — Alston & Bird LLP

(57) ABSTRACT

A fixture for the presentation of goods having at least two frame legs fixed at a defined distance from one another, wherein first retaining means for fixing presentation fittings between the frame legs and second retaining means for fixing wall elements are arranged on the sides of the frame legs which face one another, wherein the wall elements can be fixed to the second retaining means by magnetic forces, and in each case rest against or border at least one presentation fitting and cover the area between the frame legs in such a way that the first retaining means and the second retaining means are not visible.

18 Claims, 5 Drawing Sheets

(51) Int. Cl.

| | |
|---|---|
| ***A47B 57/00*** | (2006.01) |
| ***A47F 5/00*** | (2006.01) |
| ***A47B 96/14*** | (2006.01) |
| ***A47B 47/02*** | (2006.01) |
| ***A47F 5/10*** | (2006.01) |
| *A47B 47/03* | (2006.01) |
| *A47B 57/30* | (2006.01) |
| *A47B 96/20* | (2006.01) |

(52) U.S. Cl.

CPC ..... *A47B 2096/209* (2013.01); *Y10S 211/01* (2013.01)

USPC ..... 211/204; 211/103; 211/206; 211/193; 211/DIG. 1

(56) References Cited

U.S. PATENT DOCUMENTS

| | | | | | |
|---|---|---|---|---|---|
| 3,598,066 | A | * | 8/1971 | Polezoes et al. | 108/187 |
| 3,602,159 | A | * | 8/1971 | Marschak | 108/187 |
| 4,850,285 | A | * | 7/1989 | Suttles | 108/108 |
| 5,265,740 | A | * | 11/1993 | Hodsden et al. | 211/187 |
| 5,313,891 | A | * | 5/1994 | Suttles | 108/108 |
| 5,372,265 | A | * | 12/1994 | Monch | 211/187 |
| 5,415,301 | A | * | 5/1995 | Bruton et al. | 211/183 |
| 5,433,327 | A | * | 7/1995 | Benvenuti et al. | 211/193 |
| 5,531,168 | A | * | 7/1996 | Towfigh | 108/108 |
| 6,105,794 | A | * | 8/2000 | Bauer | 211/94.01 |
| 6,264,220 | B1 | * | 7/2001 | Pierce et al. | 280/79.3 |
| 6,547,088 | B1 | * | 4/2003 | Wang | 211/187 |
| 6,561,365 | B2 | * | 5/2003 | Bustos | 211/187 |
| 6,726,034 | B2 | * | 4/2004 | Holbrook et al. | 211/87.01 |
| 6,827,320 | B2 | * | 12/2004 | Yeh | 248/220.22 |
| 6,915,916 | B2 | * | 7/2005 | Martins | 211/187 |
| 8,028,846 | B2 | * | 10/2011 | Peota et al. | 211/187 |
| 8,561,820 | B2 | * | 10/2013 | Kitt et al. | 211/187 |
| 8,579,127 | B2 | * | 11/2013 | Dyck | 211/134 |
| 8,646,618 | B2 | * | 2/2014 | Peota et al. | 211/4 |
| 2002/0060198 | A1 | * | 5/2002 | Bustos | 211/187 |
| 2005/0173362 | A1 | * | 8/2005 | Squitieri et al. | 211/187 |
| 2005/0199568 | A1 | * | 9/2005 | Gay et al. | 211/187 |
| 2007/0023376 | A1 | * | 2/2007 | Black | 211/187 |
| 2008/0023427 | A1 | * | 1/2008 | Mangano | 211/187 |
| 2012/0085721 | A1 | * | 4/2012 | Michael et al. | 211/103 |
| 2013/0092061 | A1 | * | 4/2013 | Gevaert et al. | 108/64 |

FOREIGN PATENT DOCUMENTS

| | | | |
|---|---|---|---|
| DE | 20 2010 010 676 | U1 | 11/2011 |
| EP | 2 248 441 | A1 | 11/2010 |
| WO | WO-2012/113091 | | 8/2012 |

* cited by examiner

PANEL FOR EXHIBITING ITEMS, WITH CHANGEABLE ELEMENTS

CROSS-REFERENCE TO RELATED APPLICATIONS

The present application claims priority from German Patent Application No. 10 2012 202 806.4, filed Feb. 23, 2012, the content of which is hereby incorporated by reference herein in its entirety.

FIELD OF THE INVENTION

The invention relates to a fixture for the presentation of goods.

BACKGROUND OF THE INVENTION

Fixtures of the kind in question have been known in practice for years. For example, all conceivable goods are exhibited for the purchaser in shops, at trade fairs, in supermarkets etc. Fixtures, which cannot be varied and therefore cannot be adapted by the seller to suit the size of different goods or their packaging or to suit advertising campaigns, have been disclosed in the process. As the seller's range and also the arrangement of products on the selling area changes with time, there is a requirement for flexible fixtures for exhibiting goods. These fixtures for the presentation of goods must therefore be capable of being adapted to suit the wide range of products or certain temporary advertising campaigns.

The variable fixtures for the presentation of goods known in practice are mainly in the form of racking. In doing so, the goods are exhibited on the presentation fittings, for example on shelves or on blister pack holders. The presentation fittings are clipped or securely screwed in a frame or into rails. In order to be able to vary the distance between the presentation fittings or the number of presentation fittings, it is known that the frame or rails have cutouts which are spaced apart from one another and into which the presentation fittings can be clipped. The presentation fittings can therefore be fixed to the frame or to the rails at consistent intervals.

A problem particularly when presenting high-value goods is that the cutouts or screw fixings are visible to the observer. These days, goods are sometimes presented at very great expense, wherein the goods are to be presented in an aesthetic environment. At the same time, it is undesirable that the cutouts or screw fixings of the presentation fittings are visible, as these distract the purchaser from the actual goods and their presentation.

Furthermore, it is problematic that the presentation fittings can only be varied with respect to the frame or rails at consistent intervals, i.e. in steps. Once the seller has decided on a particular fixture, he is bound by the constraints of this fixture with regard to the variability of the presentation fittings.

SUMMARY OF THE INVENTION

The present invention is therefore based on the object of designing and improving a fixture for the presentation of goods of the kind mentioned in the introduction in such a way that, with structurally easy means, the fixture can be flexibly adapted to suit the goods to be presented with as little effort as possible and with an aesthetic visual appearance.

According to the invention, the object mentioned above is achieved by the various embodiments provided herein. Thereby, a fixture for the presentation of goods having at least two frame legs fixed at a defined distance from one another is specified, wherein first retaining means for fixing presentation fittings between the frame legs and second retaining means for fixing wall elements are arranged on the sides of the frame legs which face one another, wherein the wall elements can be fixed to the second retaining means by magnetic forces, in each case rest against or border at least one presentation fitting and cover the area between the frame legs in such a way that the first retaining means and the second retaining means are not visible.

In the manner according to the invention, it has initially been recognized that particular importance is attached to the frame legs. The frame legs have first and second retaining means on the sides which face one another. The first and second retaining means therefore lie in the plane enclosed by the frame legs. The first retaining means are used to fix the presentation fittings between the frame legs. Wall elements can be fixed by means of magnetic forces to the second retaining means. In doing so, the wall elements can be fixed to the retaining means in such a way that they rest against or border at least one presentation fitting. As the first and second retaining means are arranged on the sides of the frame legs which face one another, the wall elements cover the area between the frame legs. This leads to the first and second retaining means being no longer visible. As the wall elements can be fixed to the second retaining means by magnetic forces, the wall elements can be removed and for example exchanged without tools. It is therefore possible to change the visual appearance of the fixture in a simple manner, for example when different goods are to be presented.

At this point, reference is expressly made to the fact that the frame legs do not necessarily have to form a closed frame. Rather, it is important that the frame legs are arranged at a defined, fixed distance from one another and thus form a frame in the broadest sense.

In order to maximize the area on which the goods are presented, the presentation fittings can project on both sides from the plane formed by the frame legs. The fixture can stand freely in space, for example, enabling it to be equipped with goods from both sides. It is also conceivable that the presentation fittings project on one side from the plane encompassed by the frame legs. In doing so, the fixture can be arranged on or in front of a wall or fixed to the wall.

Depending on whether the fixture is arranged in free space or, for example, on or in front of a wall, the wall elements can cover the area between the frame legs from one side or from both sides.

In an advantageous manner, the frame legs can be in the form of profiled tubes or profiled rails, for example in the form of extruded profiles. At the same time, it is conceivable that the frame legs are made of metal, for example aluminum, or plastic. It is only important that the frame legs have a profile which, for example, is in the form of a T-slot.

In a particularly advantageous manner, the frame legs are arranged parallel to one another. Furthermore, it is conceivable that four frame legs which form a closed frame are provided. As a result, the frame legs are arranged at a defined distance from one another.

In order to provide the wall elements and/or the presentation fittings with electricity and/or light, a supply channel can be provided in at least one frame leg. The supply channel can carry an electrical cable or a fiber-optic cable.

In a further advantageous manner, the first and/or the second retaining means are made of plastic or metal, for example aluminum. The first and/or the second retaining means can be releasably fixed to the frame legs or to the profile of the frame legs by means of a screw and/or clamp and/or push-fit fixing. This enables the position of the first and the second retaining means on the frame legs or on the profile of the frame legs to be varied linearly. Sliding threaded inserts, for example, into which the first and/or the second retaining elements can be screwed, can be arranged in the profile of the frame legs. The retaining elements can therefore be securely clamped to the frame legs in the required position by means of this screw fixing.

The first and/or the second retaining elements can have projections, by means of which they can be clipped into the profile of the frame legs. This enables the first and/or the second retaining elements to be fixed to the frame legs in a particularly easy manner. For better fixing, the projections can have a structured surface, for example in the form of grooves. In order to introduce the projections into the profiles or slots more easily, a chamfer can be formed on the projections.

In order to fix the presentation fittings to the first retaining means as easily as possible, the first retaining means can be right-angled or be in the form of a T-piece or in the form of a double T-piece. The presentation fittings can be fixed to the retaining means by means of a clamp fixing and/or screw fixing and/or a push-fit fixing. In the case of a double T-piece, the presentation fitting can be clipped between the protruding legs of the T-piece.

In a further advantageous manner, the second retaining means can have at least one magnetized or magnetizable region. The magnetized or magnetizable region can face away from the plane encompassed by the frame legs. In a particularly advantageous manner, at least two magnetized or magnetizable regions which face away from each side of the plane encompassed by the frame legs are provided. At least one permanent magnet, for example, can be arranged on the second retaining means for this purpose. The permanent magnet can be securely glued to the second retaining means and/or clipped into an appropriate cutout in the second retaining means.

In order to fix the wall elements to the second retaining means by means of magnetic forces, the wall elements can have a magnetized or magnetizable material in at least some areas. The wall elements can be made of metal, for example. The wall elements can also be made of any other material, for example glass or plastic, in particular acrylic glass or Plexiglas. Furthermore, it is conceivable that a magnetized or magnetizable material can be glued and/or clamped and/or welded and/or clipped and/or screwed—in at least some areas—to the wall element. The magnetized or magnetizable material can be a metal foil, for example.

In a particularly advantageous manner, the wall elements are flush with the outsides of the frame legs or protrude beyond them. As a result, the frame legs are no longer visible. The wall elements can also be flush with the sides of the frame legs which face one another and lie in one plane therewith.

In order to be able to present a multiplicity of different products—for example spectacles, sports equipment or medicines—the presentation fittings can have any functional fittings which are used for presentation. For this purpose, the presentation fittings can be designed as single-sided or double-sided presentation shelves and/or as blister pack holders and/or as spectacle holders.

BRIEF DESCRIPTION OF THE SEVERAL VIEWS OF THE DRAWINGS

There are now various ways of embodying and improving the teaching of the present invention in an advantageous manner. Reference is made in this regard firstly to the various embodiments described herein, and secondly to the following explanation of preferred exemplary embodiments of the invention with reference to the drawing. Generally preferred embodiments and improvements of the teaching are also explained in conjunction with the explanation of the preferred exemplary embodiments of the invention. In the drawing.

DETAILED DESCRIPTION

Figure 1:
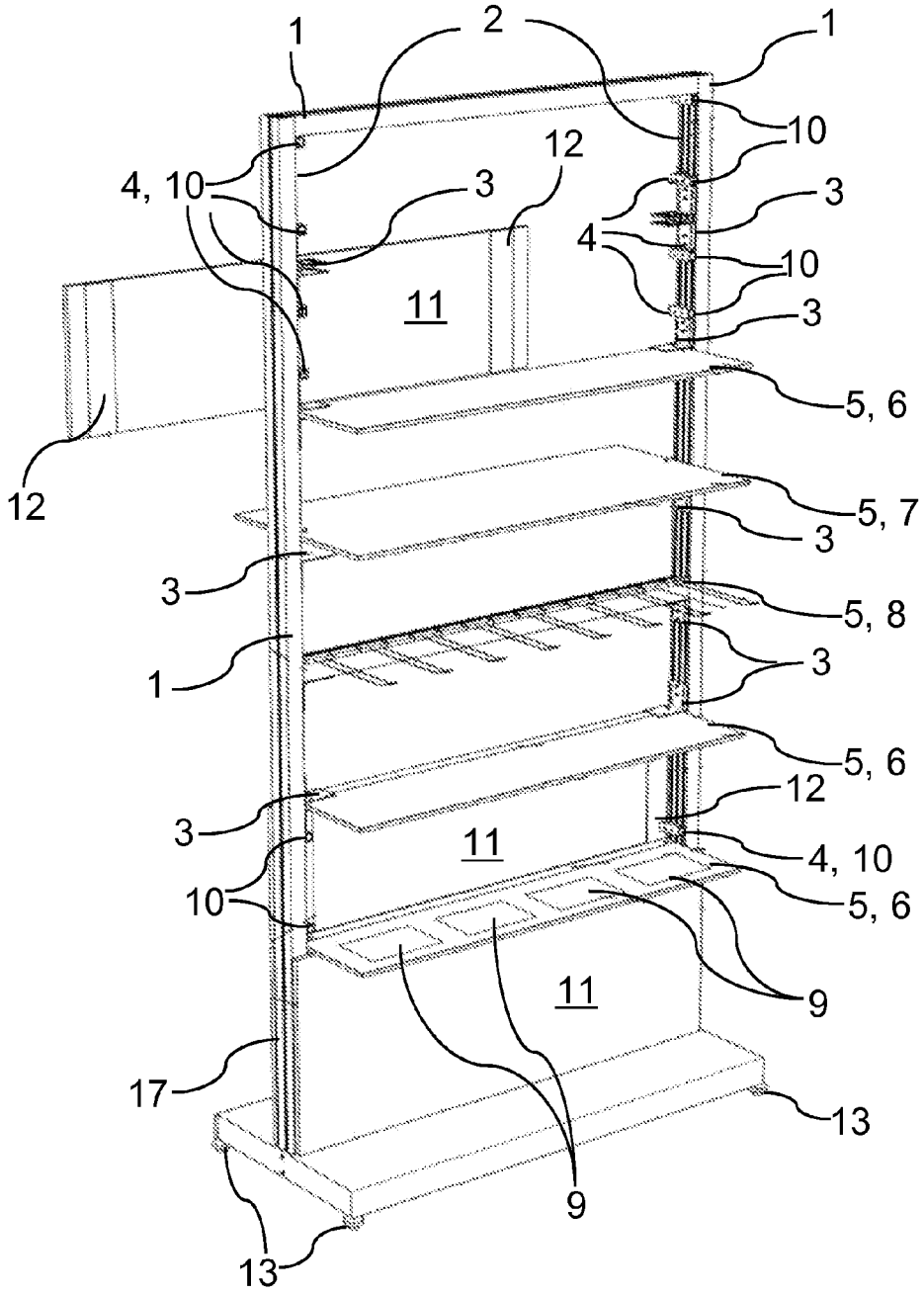
FIG. 1 shows, in a schematic diagram, a first exemplary embodiment of a fixture according to the invention in a partially dismantled state.

FIG. 1 shows a first exemplary embodiment of a fixture according to the invention in a partially dismantled state in a perspective view. The fixture has frame legs 1 which are spaced apart from one another. In the exemplary embodiment, the frame legs 1 are in the form of profile rails or extruded profiles. First retaining means 3 and second retaining means 4 are movably arranged in the profiles of the frame legs 1 on the sides 2 of the frame legs 1 which face one another.

The first retaining means 3 are designed in the form of a T-piece or a double T-piece. Presentation fittings 5 are fixed to the first retaining means 3 by a screw fixing. The presentation fittings are designed as single-sided presentation shelves 6, as double-sided presentation shelves 7 and as blister pack holder fitting 8. The single-sided presentation shelves 6 are partially made of glass or acrylic glass and have engraved areas 9. Light can be coupled into the presentation shelves 5, 6 by means of a light source, for example a fiber-optic cable or a light emitting diode, arranged at the rear so that the engraved areas 9 illuminate. For this purpose, the frame legs 1 have supply channels in which fiber-optic cables and/or electrical cables are carried. The first presentation means 3—therefore also the presentation fittings 5—can be changed in position relative to the frame legs 1 as required. The presentation fittings 5 can therefore be fixed at any height.

The second retaining means 4 have magnetized regions in the form of permanent magnets 10. The permanent magnets 10 face away from the plane encompassed by the frame legs 1 on both sides. Wall elements 11 are fixed by means of magnetic forces to the second retaining means 4. The wall elements 11 have magnetizable regions for this purpose. The magnetizable regions are formed by metal strips 12 which are securely glued to the wall elements 11. The wall elements 11 are made of metal or glass or acrylic glass and are fixed to the permanent magnets 10 of the second retaining means 4 by means of the metal strips 12. The wall elements 11 are flush with the outsides 17 of the frame legs 1 and cover the area between the frame legs 1. The first retaining means 3 and the second retaining means 4 are therefore no longer visible.

The wall elements 11 can have different sizes and/or visual appearances and be moved against or with the second retaining means 4. The wall elements 11 can therefore be slid towards the presentation fittings 5 so that the wall elements 11 rest against or border the presentation fittings 5.

In order to adapt the fixture to suit a product to be presented, the presentation fittings 5 and/or the wall elements 11 can be exchanged and/or adjusted in height without tools.

Feet 13, on which the fixture stands, are provided in order to be able to position the fixture freely in space. The feet 13 can be designed to be adjustable in height by means of a thread in order to compensate for any unevenness of the floor. Goods can be presented on both sides of the fixture by means of the double-sided presentation shelves 7. The area between the frame legs 1 is sealed by the wall elements 11.

Figure 2:
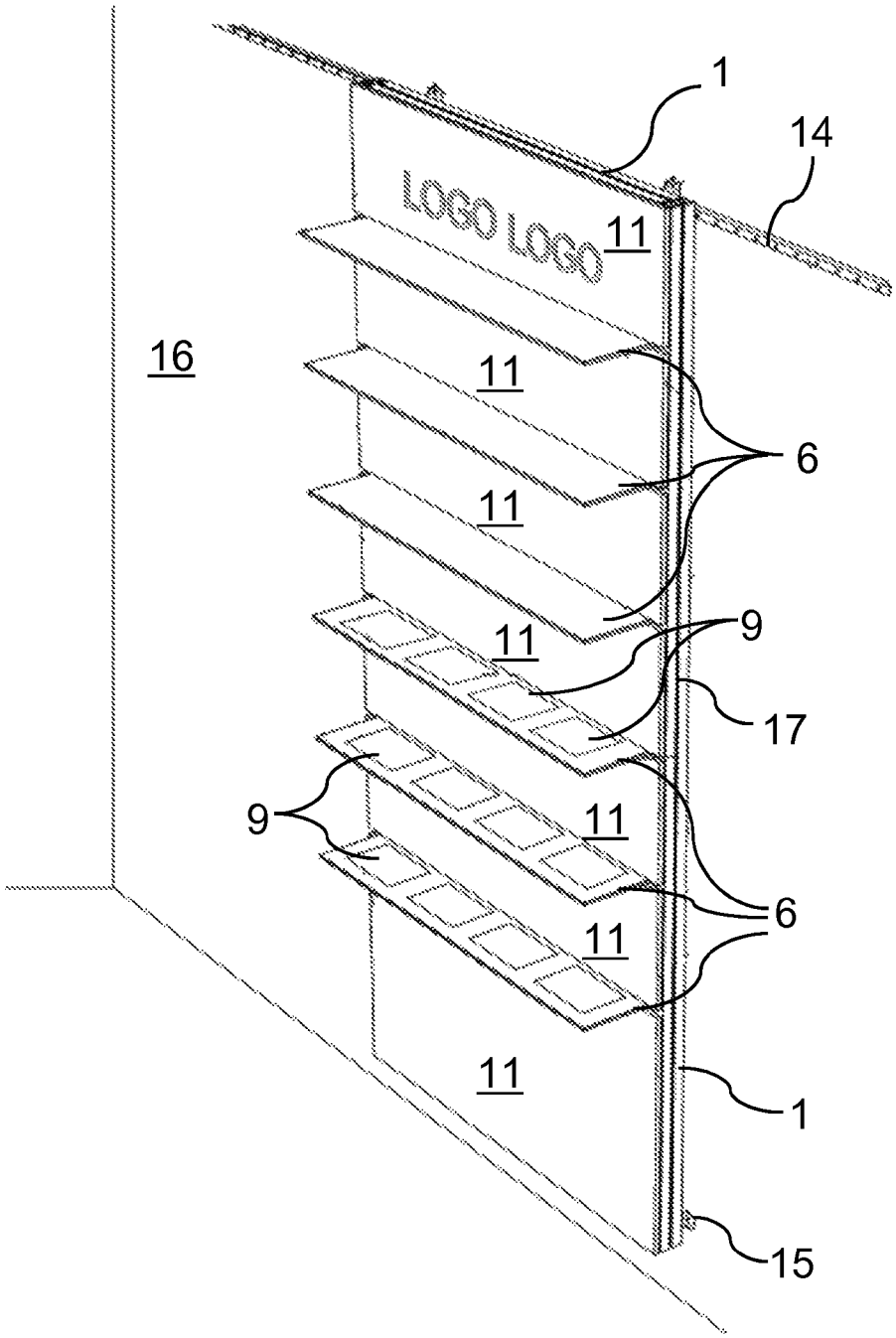
FIG. 2 shows, in a schematic diagram, a second exemplary embodiment of a fixture according to the invention.

A further exemplary embodiment of the fixture according to the invention is shown in a perspective view in FIG. 2. The fixture is arranged on a wall 16 by its frame legs 1 by means of a rail 14 and retaining brackets 15. For reasons of clarity, only some of the engraved areas 9 are referenced in FIG. 2.

The wall elements 11 are arranged between the presentation fittings 5 and above and below the last presentation fitting 5 respectively in each case. In the exemplary embodiment shown here, the wall elements are flush with the outsides 17 of the frame legs 1 and directly border the presentation fitting 5. The wall elements 5 completely close the area between the frame legs 1 and therefore cover the first retaining means 3 and the second retaining means 4. The wall elements 5 can carry an advertising inscription for example. The fixture can also be fixed to the wall 16 by means of two rails 14 and be movable on the rails 14. The fixture according to FIG. 2 does not stand on feet and has wall elements 11 and presentation fittings 5 on only one side of the plane formed by the frame legs 1, but otherwise corresponds to the exemplary embodiment according to FIG. 1. To avoid repetition, reference is therefore made at this point to the comments relating to FIG. 1.

Figure 3:
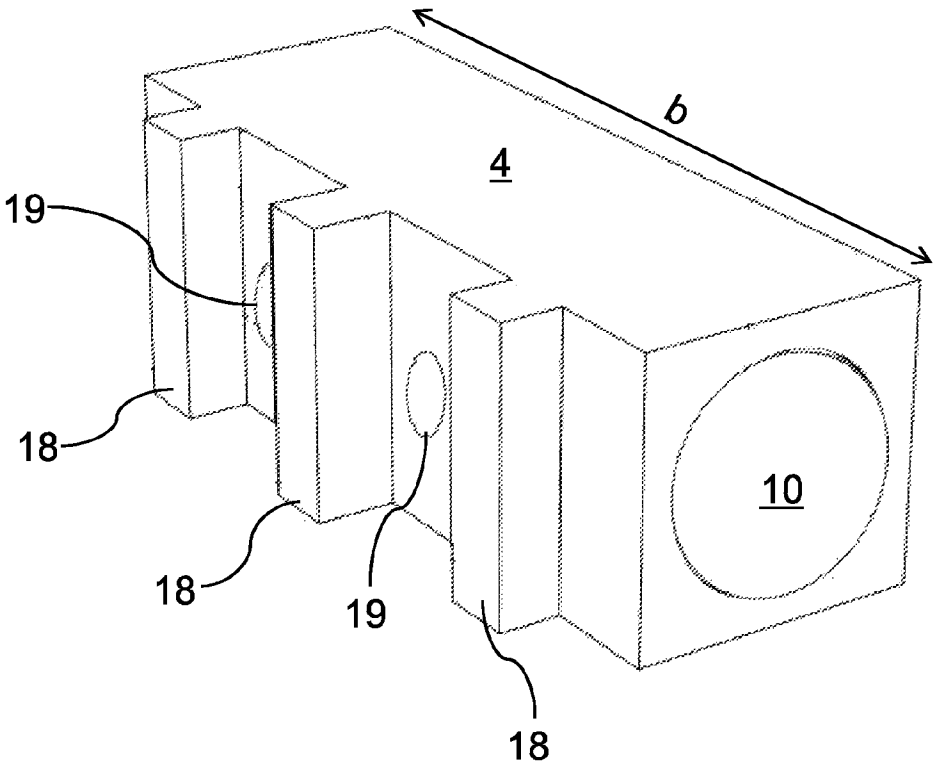
FIG. 3 shows, in a schematic diagram, an exemplary embodiment of a second retaining element.

An exemplary embodiment of second retaining means 4, as used, for example, in the exemplary embodiments according to FIG. 1 and FIG. 2, is shown in FIG. 3. The second retaining means 4 is made of plastic. A permanent magnet 10 is clipped into the second retaining means 4. For better fixing, the permanent magnet 10 can be glued to the second retaining means 4. The permanent magnet 10 can be provided on both sides or on only one side of the second retaining means 4. The width b of the second retaining means 4 can be such that the wall element 11 according to FIG. 1 and FIG. 2 is flush with the outsides 17 of the frame legs 1. The width b of the second retaining means 4 can also be slightly less, such that the wall element 5 is arranged between the frame legs 1 and lies in one plane with the frame legs 1.

The second retaining means 4 has projections 18. The second holding means 4 is clipped or clamped securely into the profiles of the frame legs by means of the projections 18. The second holding means 4 can therefore be changed in position relative to the frame legs 1 without tools. The position of the second holding means 4 can be adapted to suit any wall element 11. In this exemplary embodiment, the surface of the projections 18 is smooth. In order to hold the second retaining means 4 securely in the profiles of the frame legs 1, the surface 18 of the projections can have a structure, for example grooves. Passages 19 are provided for fixing the second retaining means 4 to any frame legs 1. The passages 19 serve to accommodate fixing means, for example screws, with which the second retaining means 4 can be fixed to a frame leg 1.

Figure 4:
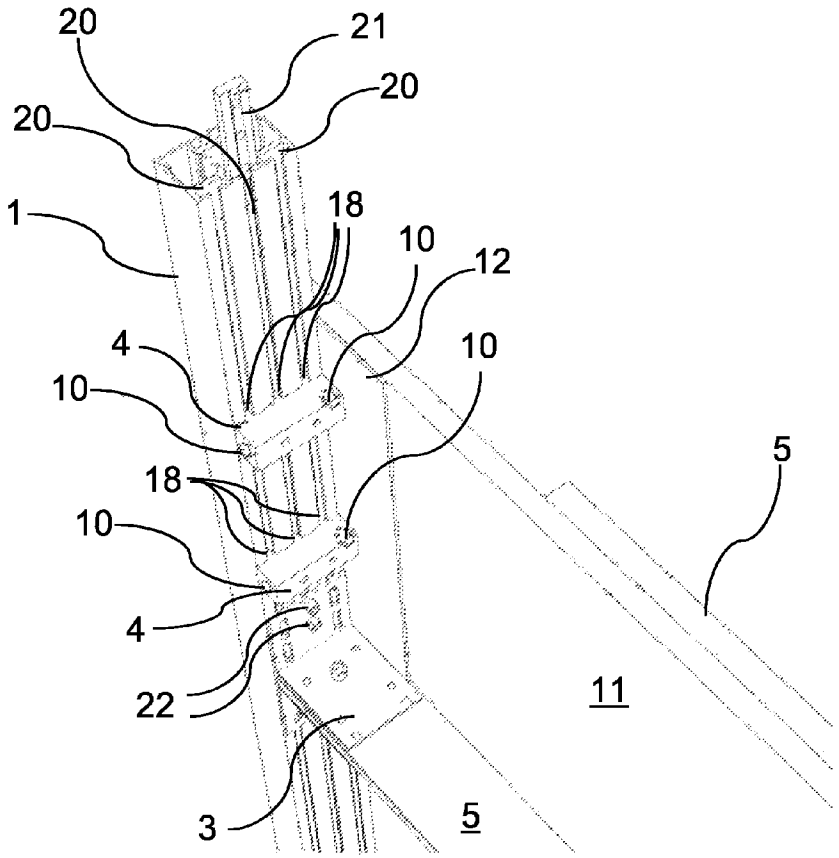
FIG. 4 shows, in a schematic diagram, an exemplary embodiment of a frame leg.

FIG. 4 shows an exemplary embodiment of a frame leg 1, for example for a fixture according to the invention according to FIG. 1 or FIG. 2. The frame leg 1 is designed as a profile rail. The profile of the frame leg 1 is designed in the form of T-slots 20. Second retaining means 4 are clipped by means of their projections 18 in the T-slots 20. The wall element 11 is fixed by means of its metal strip 12 to the permanent magnets 10 of the second retaining means 4. In this diagram, the permanent magnets 10 of the second retaining means 4 face away from the plane encompassed by the frame legs 1 on both sides. A threaded insert 21 is also shown in FIG. 4. The threaded insert 21 can be moved in the T-slots 20. The first retaining means 3 are connected to such a threaded insert 21 by means of screws 22. Here, the first retaining means 3 are designed as a double T-piece. The presentation fitting 5 is slid between the protruding legs of the double T-piece 3 and screwed to the double T-piece 3. The first retaining means 3—therefore also the presentation fitting 5—can be moved linearly, i.e. discontinuously, in the T-slots 20. The presentation fitting 5 can therefore be arranged in any position or at any height. Furthermore, it can be clearly seen from FIG. 4 that the wall element 11 borders the presentation fitting 5 or rests thereon.

Figure 5:
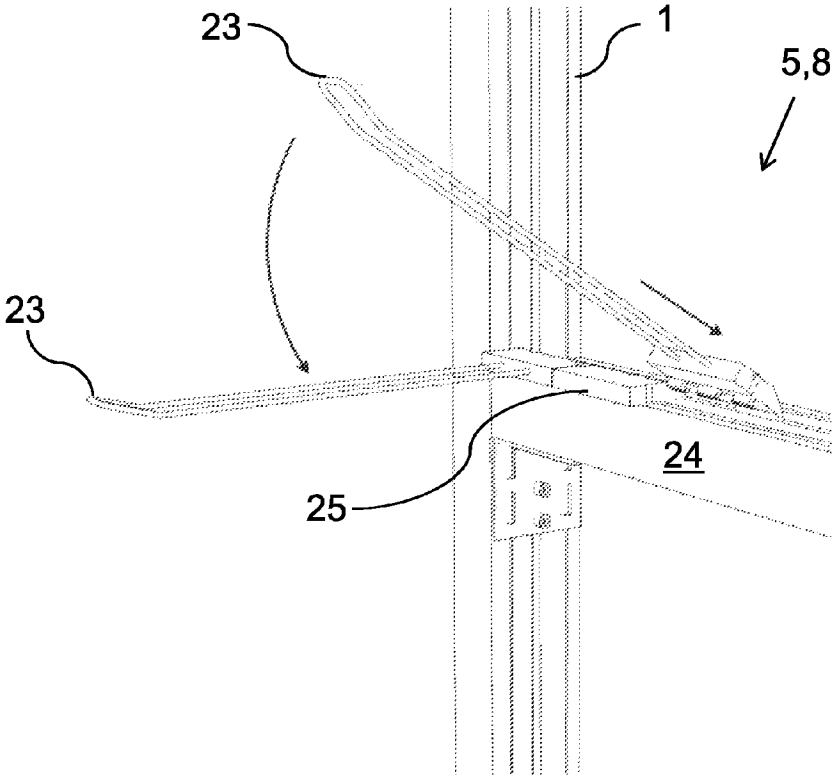
FIG. 5 shows, in a schematic diagram, an exemplary embodiment of a presentation fitting.

A presentation fitting 5 designed as a blister pack holder fitting 8 is shown in FIG. 5. The blister pack holder fitting 8 has a plurality of individual blister pack holders 23 which can be clipped into a cross-member 24. The cross-member 24 is fixed to the frame legs 1 by means of first retaining means 3, enabling its height to be adjusted. The blister pack holders 23 are made from bent wire for example. Blanking elements 25, which can be arranged between the blister pack holders 23 on the profile of the cross-member 24, are provided in order to separate the blister pack holders 23 from one another. The blanking elements 25 can have any size and visual form. Any number of blanking elements 25 can be arranged between the blister pack holders 23 depending on how close to one another the blister pack holders 23 are to be. If the blister pack holders 23 are to be immediately next to one another, then the blanking elements 5 can be omitted.

With regard to further advantageous embodiments of the fixture according to the invention, reference is made to the general part of the description and to the attached patent claims in order to avoid repetition.

Finally, it is expressly pointed out that the exemplary embodiments of the fixture according to the invention described above are used only in the discussion of the claimed teaching, but this is not restricted to the exemplary embodiments.

What is claimed is:

1. A fixture for the presentation of goods, said fixture comprising:

at least two frame legs fixed at a defined distance from one another, presentation fittings configured to receive one or more goods for presentation, first retaining means configured to maintain a portion of the presentation fittings between the frame legs, wall elements configured to span an area between the frame legs, second retaining means configured to connect the wall elements to the frame legs, wherein the first retaining means and the second retaining means are arranged on the sides of the frame legs which face one another, wherein the wall elements or the second retaining means comprise magnetic force such that the wall elements can be fixed to the second retaining means by magnetic force, wherein each wall element rests against or borders at least one presentation fitting and covers the area between the frame legs in such a way that each wall element is configured to be disposed between one of the one or more goods and at least one of both the first retaining means and the second retaining means.

2. The fixture as claimed in claim 1, wherein the presentation fittings project on one side or on both sides from a plane formed by the frame legs.

3. The fixture as claimed in claim 1, further comprising secondary wall elements, wherein the secondary wall elements cover the area between the frame legs in such a way that each of both the first retaining means and the second retaining means are configured to be disposed on a same side of the secondary wall elements as the one or more goods.

4. The fixture as claimed in claim 1, wherein the frame legs are profiled rails.

5. The fixture as claimed in claim 4, wherein the first retaining means or the second retaining means are releasably fixed to the profile of the frame legs by a screw fixing or clamp fixing or push-fit fixing thus enabling a position of the first retaining means or the second retaining means on the profile to be varied.

6. The fixture as claimed in claim 4, wherein the first retaining means or the second retaining means have projections, wherein the projections are clipped into the profile of the frame legs and have a structured surface.

7. The fixture as claimed in claim 1, wherein the frame legs are arranged parallel to one another.

8. The fixture as claimed in claim 1, wherein four frame legs are provided, wherein the four frame legs form a closed frame.

9. The fixture as claimed in claim 1, wherein the frame legs have at least one supply channel.

10. The fixture as claimed in claim 1, wherein at least one of the first retaining means and the second retaining means is made of plastic or metal.

11. The fixture as claimed in claim 1, wherein the first retaining means are right-angled or a T-piece or a double T-piece.

12. The fixture as claimed in claim 1, wherein the presentation fittings are fixed to the first retaining means by a screw fixing or a push-fit fixing.

13. The fixture as claimed in claim 1, wherein the second retaining means have at least one magnetized or magnetizable region.

14. The fixture as claimed in claim 13, wherein the second retaining means have at least one permanent magnet.

15. The fixture as claimed in claim 1, wherein the wall element has a magnetized or magnetizable material in at least some areas, wherein the magnetized or magnetizable material is glued or clamped or welded or clipped or screwed to the wall element.

16. The fixture as claimed in claim 1, wherein the wall element is flush with the outsides of the frame legs or protrudes beyond outsides of the frame legs, or that the wall element is flush with the sides of the frame legs which face one another and forms one plane with the frame legs.

17. The fixture as claimed in claim 1, wherein the presentation fittings are single-sided or double-sided presentation shelves or as blister pack holders or as spectacle holders.

18. The fixture in claim 1, further comprising secondary wall elements, wherein the secondary wall elements cover the area between the frame legs in such a way that each of both the first retaining means and the second retaining means are configured to be disposed on an opposite side of the secondary wall elements as the one or more goods.

* * * * *